US006582066B1

(12) United States Patent
Temple

(10) Patent No.: US 6,582,066 B1
(45) Date of Patent: Jun. 24, 2003

(54) DROPLET DEPOSITION APPARATUS AND METHODS OF MANUFACTURE THEREOF

(75) Inventor: Stephen Temple, Cambridge (GB)

(73) Assignee: Xaar Technology Limited, Cambridge (GB)

( * ) Notice: Subject to any disclaimer, the term of this patent is extended or adjusted under 35 U.S.C. 154(b) by 0 days.

(21) Appl. No.: 09/444,603

(22) Filed: Nov. 22, 1999

Related U.S. Application Data

(63) Continuation of application No. PCT/GB98/01495, filed on May 22, 1998.

(30) Foreign Application Priority Data

May 23, 1997 (GB) ..... 9710530

(51) Int. Cl.[7] ..... B41J 2/045
(52) U.S. Cl. ..... 347/68
(58) Field of Search ..... 347/68, 69, 70, 347/71, 50

(56) References Cited

U.S. PATENT DOCUMENTS

| | | | | |
|---|---|---|---|---|
| 4,326,205 A | * | 4/1982 | Fischbeck et al. | 347/68 X |
| 4,549,191 A | | 10/1985 | Fukuchi et al. | |
| 5,227,813 A | | 7/1993 | Pies et al. | |
| 5,432,540 A | | 7/1995 | Hiraishi | 347/69 |
| 5,455,615 A | | 10/1995 | Burr et al. | 347/92 |
| 5,889,539 A | * | 3/1999 | Kamoi et al. | 347/50 |

FOREIGN PATENT DOCUMENTS

| | | | |
|---|---|---|---|
| EP | 0 278 590 A1 | 8/1988 | B41J/3/04 |
| EP | 0 364 136 A3 | 4/1990 | B41J/2/155 |
| EP | 0 376 606 A1 | 7/1990 | B41J/2/045 |
| EP | 0 522 814 A2 | 1/1993 | |
| EP | 0 595 654 A2 | 5/1994 | |
| EP | 0 628 413 A2 | 12/1994 | |
| EP | 0 670 222 A2 | 9/1995 | |
| EP | 0 722 838 A2 | 7/1996 | |
| EP | 0 723 869 A2 | 7/1996 | |
| EP | 0 750 987 A1 | 1/1997 | |
| JP | 7-76083 | 3/1995 | |
| JP | 9-94952 | 4/1997 | |
| WO | WO 91/17051 | 11/1991 | B41J/2/16 |
| WO | WO 92/10367 | 6/1992 | |
| WO | WO 92/22429 | 12/1992 | B41J/2/045 |

OTHER PUBLICATIONS

English language abstract for Japanese language document 9–94952.

English language abstract for Japanese language document 7–76083.

* cited by examiner

*Primary Examiner*—Raquel Yvette Gordon
*Assistant Examiner*—C Dickens
(74) *Attorney, Agent, or Firm*—Marshall, Gerstein & Borun

(57) ABSTRACT

Droplet deposition apparatus comprising first and second channels (82*a*, 82*b*), one end of each channel communicating with a single, common supply chamber (40) for supply of droplet liquid and the respective other ends of the first and second channels each communicating with a respective further supply chamber (88, 92) for supply of droplet liquid; each of said first and second channels having an opening (96*a*, 96*b*) for ejection of droplets therefrom; and actuator means being associated with each channel for effecting the ejection of droplets.

23 Claims, 8 Drawing Sheets

*PRIOR ART*

DROPLET DEPOSITION APPARATUS AND METHODS OF MANUFACTURE THEREOF

This is a continuation of International Application No. PCT/GB98/01495 filed May 22, 1998, the entire disclosure of which is incorporated herein by reference.

FIELD OF THE INVENTION

The present invention relates to droplet deposition apparatus, in particular an inkjet printhead.

BACKGROUND OF THE INVENTION

FIG. 1 shows an inkjet printhead of the kind disclosed in WO91/17051 and made up of a body formed with an array of open-topped channels which are closed by a cover. Each channel is connected at either end to a respective ink supply chamber and at its middle to a nozzle formed in the cover. The channel walls comprise piezoelectric material that deflects when subjected to an electric field and causes the ejection of an ink droplet from the respective nozzle.

SUMMARY OF THE INVENTION

Preferred forms of the present invention have as an objective a device of the kind described above which is simple and cheap to manufacture.

In one aspect the invention comprises droplet deposition apparatus comprising: a body formed with at least one channel open on one side, the channel communicating at each end with a supply chamber for supply of droplet fluid, actuator means being associated with each channel for effecting ejection of droplets; a cover closing the open side of the at least one channel and having formed therein at least one opening for ejection of droplets from the channel; and a base defining with the cover the supply chambers communicating with the respective ends of the at least one channel.

In such a construction, ink supply chambers that are defined by the base and cover require less critical tolerances than when they are formed in the "active" body, as in WO91/17051. Furthermore, the base can be made of a material that is less expensive than that from which the body—the "active" component in the printhead—is formed.

A second aspect of the invention involves the control means of inkjet printheads and comprises droplet deposition apparatus comprising: a body formed with at least one chamber open on one side, each chamber communicating with an opening for ejection of droplets therefrom and with a manifold for supply of droplet fluid, actuator means being associated with each chamber for effecting ejection of droplets in response to electrical signals and a cover closing the open side of the at least one chamber; the manifold being defined at least in part by a base, the base also defining at least in part a further chamber, control means for supplying the electrical signals to the actuator means being located in the further chamber.

In this fashion, the control means—generally an integrated circuit—is itself integrated into the printhead construction, thereby increasing compactness and reducing the exposure of the integrated circuit to the environment.

In a third aspect, the present invention consists in droplet deposition apparatus comprising first and second channels, one end of each channel communicating with a single, common supply chamber for supply of droplet liquid and the respective other ends of the first and second channels each communicating with a respective further supply chamber for supply of droplet liquid; each of said first and second channels having an opening for ejection of droplets therefrom; and actuator means being associated with each channel for effecting the ejection of droplets.

Such an arrangement results in a compact construction in which droplet fluid can be passed from the single, common liquid supply chamber, through each of the first and second channels, and out into the respective further liquid supply chamber. Flow can also take place in the reverse direction. Such circulation can serve a number of purposes that are known per se, e.g. removal of dirt and air bubbles, cooling of the channel.

According to a fourth aspect, the invention consists in droplet deposition apparatus comprising a body formed with at least one chamber having an open side, each chamber communicating with a supply of droplet fluid and an opening for ejection of droplets therefrom; actuator means being associated with each chamber for effecting ejection of droplets in response to electrical signals, a support member for said body, the support member closing the open side of said chamber and having at least one track thereon for conveying electrical signals to respective actuator means, and having formed therein at least one opening for ejection of droplets from respective chambers.

This configuration has been found to be particularly suited to manufacture: the support member is not merely a support during manufacture for the active body components—and, advantageously, drive chips mounted on the conductive tracks it also provides location for each nozzle associated with each chamber in the bodies. An associated method is also comprised within the present invention.

A fifth aspect of the invention relates to a substrate having electrically conductive tracks, there being a plurality of locations along each track at which an integrated circuit may be connected; the plurality of locations being spaced relative to one another along each track such that, for each track, a location lying adjacent a connection to an integrated circuit die falls outside the footprint of the integrated circuit die.

In the event of a mounted integrated circuit—particularly a printhead drive chip—proving faulty, this measure allows a replacement chip to be connected to tracks on a substrate without having to remove the faulty chip, with the potential damage to the substrate that removal implies. Manufacturing yield benefits correspondingly. An associated method is also comprised within the present invention.

BRIEF DESCRIPTION OF THE DRAWINGS

Advantageous embodiments of the aforementioned aspects are set out in the dependent claims (which are incorporated by reference here as consistory clauses) and in the description that follows.

The invention will now be described by way of example with reference to the following drawings, in which.

DETAILED DESCRIPTION OF THE PREFERRED EMBODIMENTS

Figure 1:
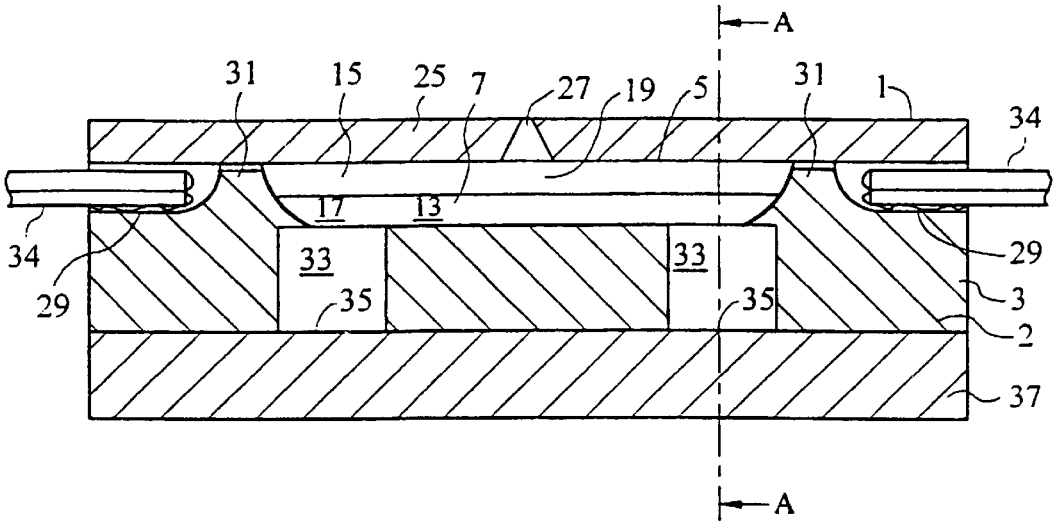
PRIOR ART Fig. 1
FIG. 1 shows a prior art inkjet printhead of the kind disclosed in WO91/17051.

FIG. 1 shows a prior art inkjet printhead 1 of the kind disclosed in WO91/17051 and comprising a sheet 3 of piezoelectric material, suitably lead zirconium titanate (PZT), formed in a top surface thereof with an array of open-topped ink channels 7. As evident from FIG. 2, successive channels in the array are separated by side walls 13 which comprise piezoelectric material poled in the thickness direction of the sheet (as indicated by arrow P). On opposite channel-facing surfaces 17 are arranged electrodes 15 to which voltages can be applied via connections 34. As is known, e.g. from EP-A-0 364 136, application of an electric field between the electrodes on either side of a wall results in shear mode deflection of the wall into one of the flanking channels, generating a pressure pulse in that channel.

Figure 2:
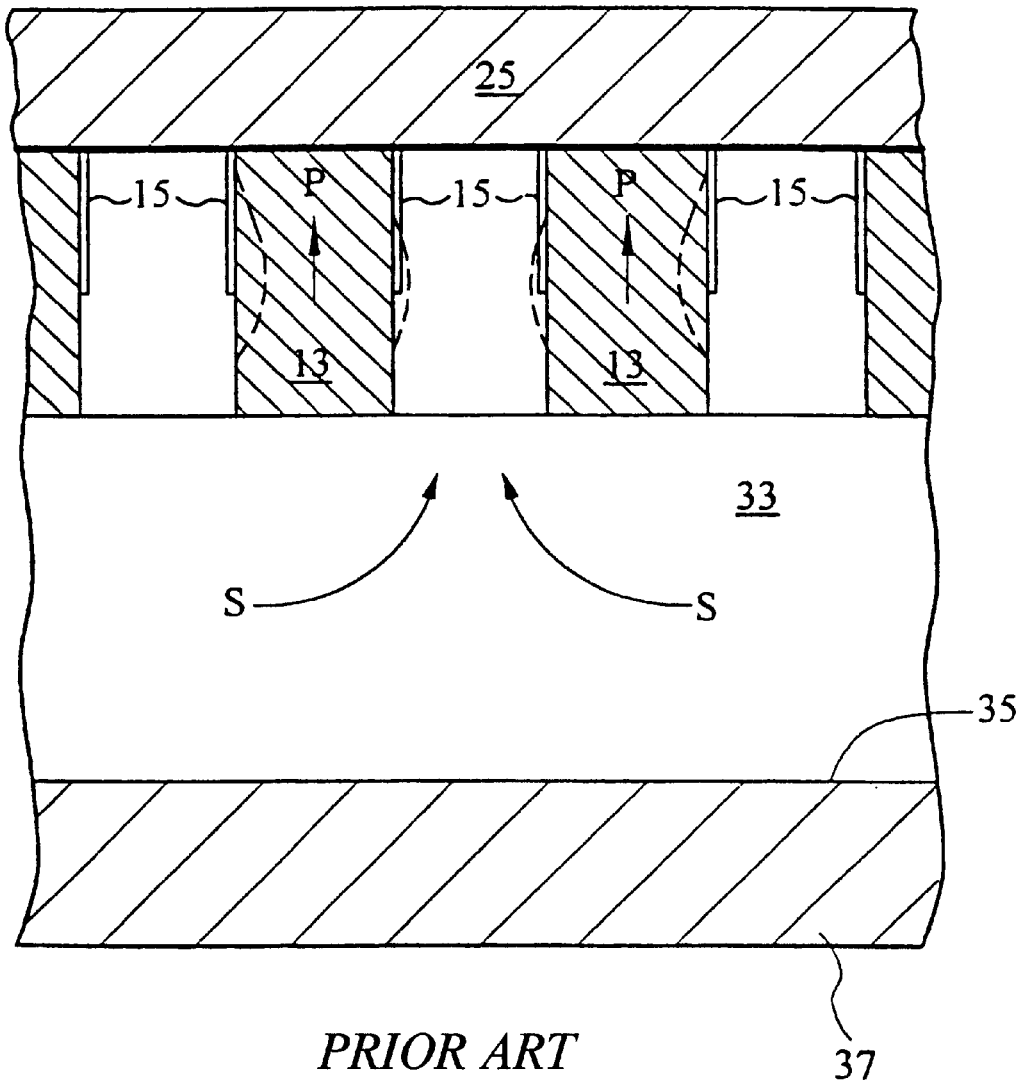
FIG. 2 is a sectional view taken along line A—A of FIG. 1.

The channels are closed by a cover 25 in which are formed nozzles 27 each communicating with respective channels at the-mid-points thereof. Droplet ejection from the nozzles takes place in response to the aforementioned pressure pulse, as is well known in the art. Supply of droplet fluid into the channel, indicated by arrows S in FIG. 2, is via two ducts 33 cut into toe bottom face 35 of the sheet 3 to a depth such that they communicate with opposite ends respectively of the channels 7. A base cover plate 37 is bonded to the bottom face 35 to close the ducts.

Figure 3:
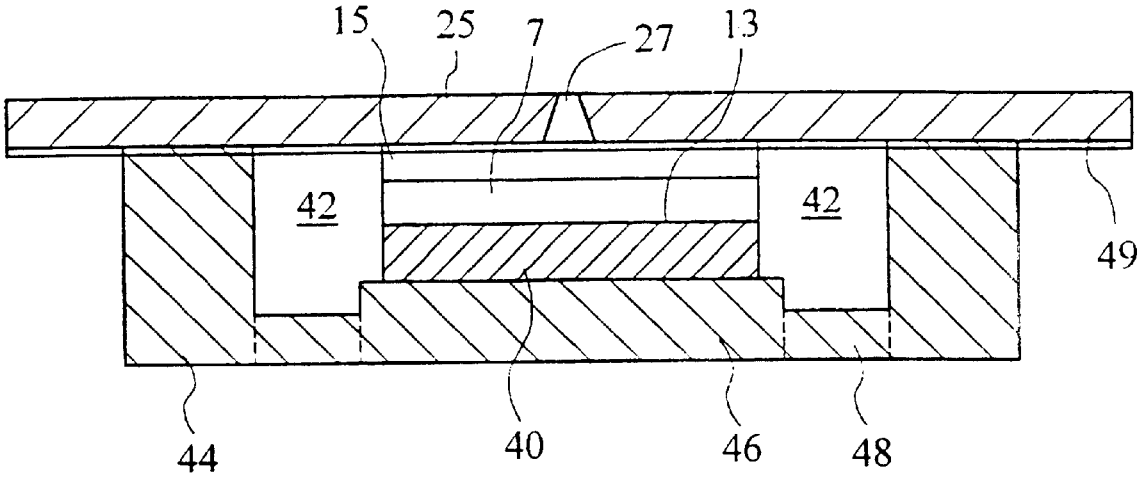
FIG. 3 shows a printhead incorporating a first aspect of the present invention.

FIG. 3 shows an embodiment of a printhead according to a first aspect of the invention.

As in the conventional construction, open-topped ink channels 7 defining side walls 13 are formed in a body 40 of piezoelectric material. By means of electrodes 15 formed on opposite channel-facing surfaces of each side wall 13, electric fields can be applied to cause shear mode deflection of the wall and droplet expulsion from one of the flanking channels. The open-topped channels 7 are closed by a cover 25 on which may also be formed conductive tracks 49 for supplying voltages to respective electrodes 15. Tracks and electrodes may be connected via solder bonds as described in WO 92/22429. The cover is also formed, for each channel, with a nozzle 27 communicating with the mid-point of each channel and through which droplet expulsion takes place. Conductive tracks and associated solder bonds may have to be shaped and/or removed to accomodate such a nozzle.

In accordance with the invention, however, droplet fluid is supplied to each end of the channels 7 from a chamber 42 that is defined on two sides by a base 44, on a third side by the cover 25 and which communicates on a fourth side with the end of the channel 7. It will be apparent that the interface between the channel and the chamber in such a construction is determined simply by the channel depth.

Since variations in the height of the body 40 and the thickness of the adjacent part (pedestal 46) of the base can be accomodated by flexure (up or down in the embodiment of FIG. 3) of the cover 25, manufacture can be carried out to looser tolerances.

Base 44 need not be made of the same material as the body, advantageously being made of a cheaper, non-active material that is nevertheless thermally matched to the piezoelectric material of the body and which has good thermal conductivity so as to carry away the heat generated in the active printhead bodies and driver chips. As shown in FIG. 3, chambers 42 may be deeper than body 40 so as to increase their cross-sectional area and thus the number of channels a single chamber can supply. However, the level of the pedestal 46 may be reduced to that of the bottom of chamber 42, resulting in a rectangular-sectioned cavity in the base that can be more simply manufactured. The width of pedestal 46 can also be varied so as to be wider or narrower than the body 40.

Body 40 will generally comprise an array of channels—as is well-known e.g. from EP-A-0 278 590—and chambers 42 will act as a common manifold for at least some of these. Apertures 48 allow supply of droplet liquid into chambers 42 from a reservoir such as a cartridge.

Base 44 may have a structural role, having cover 25 and active body 40 attached thereto, and being formed with lugs (not shown) for securing to the frame of a printer or similar.

Figure 4:
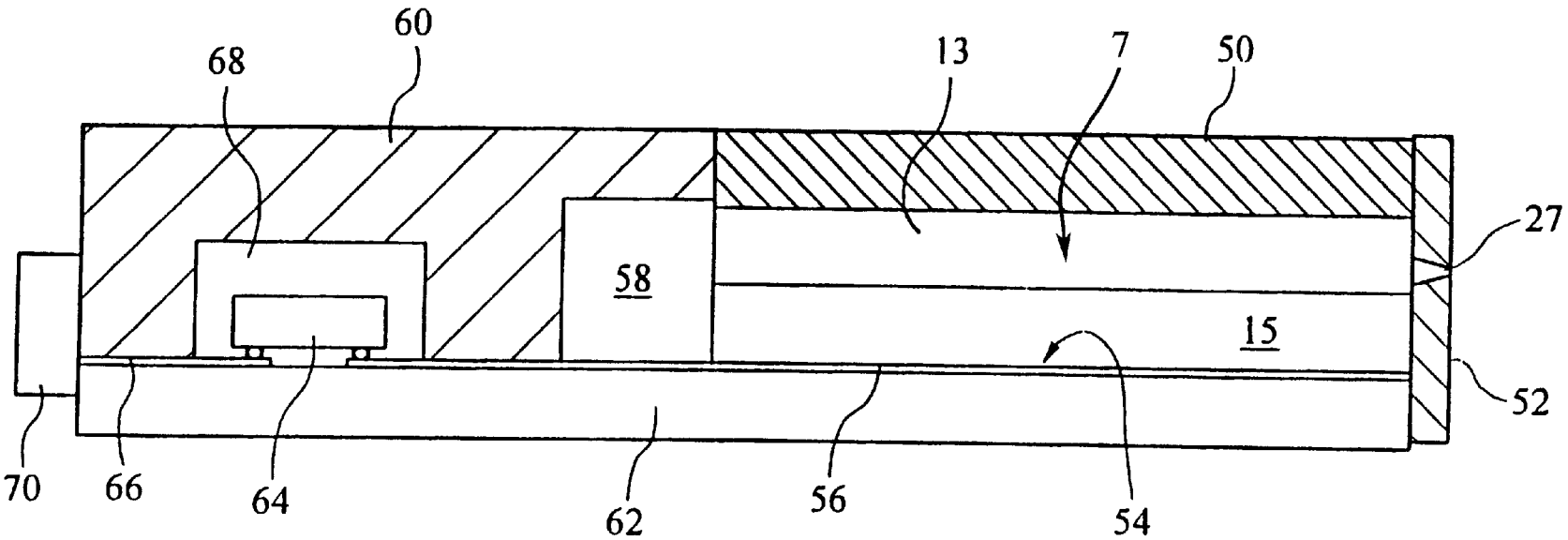
FIG. 4 shows a printhead incorporating a second aspect of the present invention.

A second aspect of the invention when applied to an inkjet printhead of the kind disclosed in WO92/22429 is illustrated in FIG. 4. This shows a sectional view along an open-topped ink channel 7 formed in a body 50 of piezoelectric material and closed by a substrate 62. Electrodes 15 extend over each channel-separating side wall 13 in the conventional manner but are connnected at the open top 54 of the channel with a conductive track 56 formed on the substrate 62.

Advantageously, the two electrodes on the channel-facing wall surfaces defining a given channel are connected to a common track. Each track is connected to a drive circuit in the form of a microchip 64 which is itself mounted on the tracks 56 on the substrate, print data, power, etc being supplied to the chip via further tracks 66 and connector 70. A nozzle 27 formed in a nozzle plate 52 is located at one end of the channel for droplet ejection whilst a manifold 58 is located at the other end of the channel for supply of droplet liquid.

In accordance with the invention, the manifold 58 is defined by a base 60 acting in combination with the body 50. The base also defines, this time in combination with the substrate 62, a further chamber 68 in which is located the drive circuit 64. It will be appreciated that a particular advantage of such an integrated construction is the protection afforded the drive chip. Although the use of piezoelectric material for the base is not excluded—indeed body 50 and base 60 may be integral, base 60 is advantageously made from a cheaper, non-active material.

Figure 5:
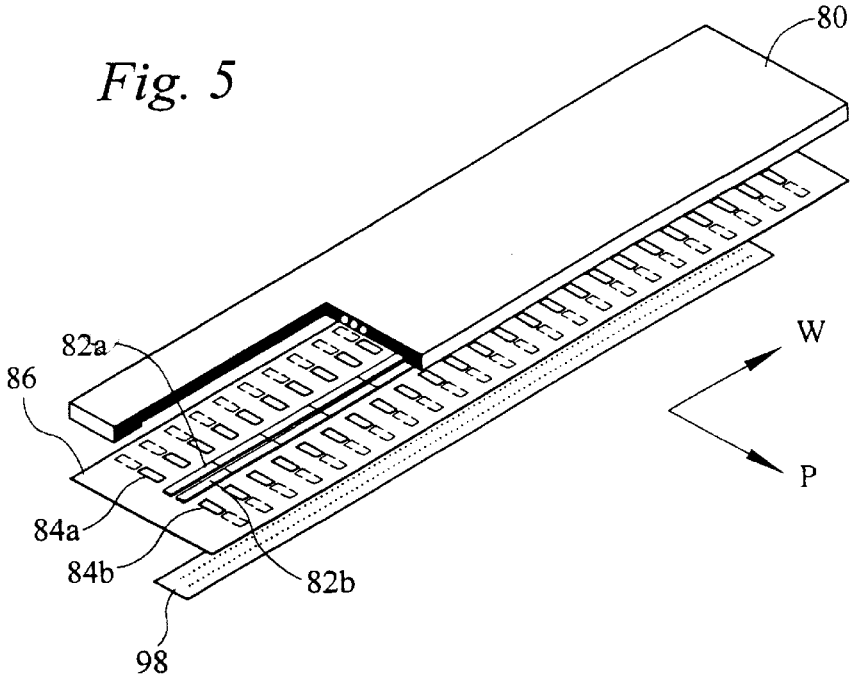
FIG. 5 is an exploded perspective view of a "pagewide" printhead according to the present invention.
Figure 6:
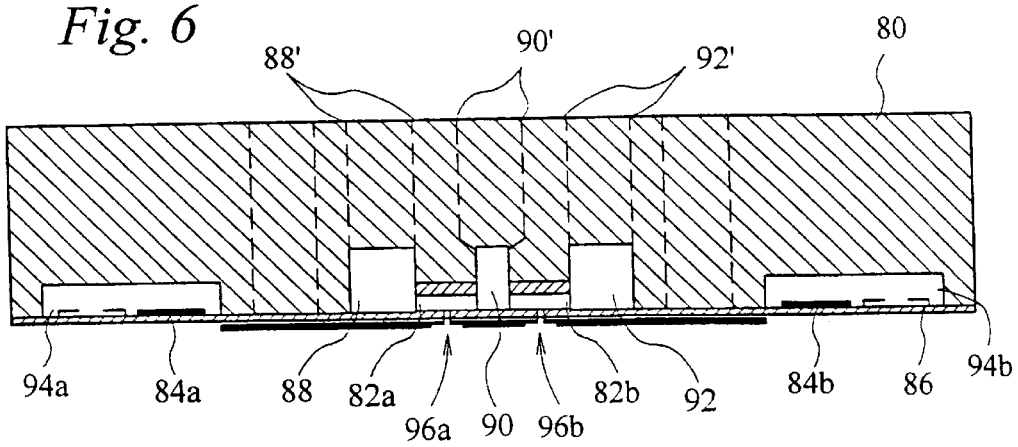
FIG. 6 is an assembled sectional view of the printhead of FIG. 5 taken normal to direction "W"

FIGS. 5 and 6 are exploded perspective and sectional views respectively of a "pagewide" printhead incorporating both first and second aspects referred to above and extending in a direction "W" transverse to a media feed direction P. In the sectional view of FIG. 6, two piezoelectric bodies 82*a*, 82*b* each having channels and electrodes as described above are closed by a substrate 86 in which openings 96*a*,96*b* for droplet ejection are formed. In accordance with the first aspect of the invention, respective supply chambers at the ends of the channels in each body, namely supply chambers 88 and 90 at either end of body 82*a* and supply chambers 90 and 92 at either end of body 82*b*, are defined between the substrate 86 and a base 80. Respective channel electrodes are connected to conductive tracks (not shown) on the substrate 86 as described with regard to FIG. 4. These conductive tracks also carry respective driver chips 84*a* and 84*b* located, in accordance with the second aspect of the invention, in further chambers 94*a*,94*b* defined by the base 80. Understandably, the further chambers 94*a*,94*b* are sealed from supply chambers 88 and 92.

This embodiment incorporates a third aspect of the present invention: the channel-closing substrate 86 with conductive tracks for conveying electrical signals to actuator means located in the channels and openings 96*a*,96*b* for droplet ejection acts as a support member for the bodies 82*a* and 82*b*. As will be evident from FIG. 5, bodies 82 and drive chips 84 are aligned and fixed to the substrate 86—which in turn can be made to such a size as to be easy to handle during manufacture.

As illustrated in FIG. 5, bodies 82 may be butted together to form a single, contiguous, pagewide array of channels—described in WO91/17051 and consequently not in any further detail here—in which case the substrate 86 serves to support the individual bodies both during and after the butting process. Such bodies may be tested before assembly, thereby reducing the chances of a complete printhead being faulty.

The substrate is suitably made of a robust material—such as aluminium nitride, INVAR or special glass AF45—that has similar thermal expansion characteristics to the piezoelectric material of the bodies. It will be appreciated that the requirement for thermal matching between bodies and substrate is reduced where there is a gap between successive butted bodies (the gap advantageously being filled with glue bond material as mentioned in the aforementioned WO91/17051) in which case a less well thermally-matched material such as alumina can be used.

Figure 7:
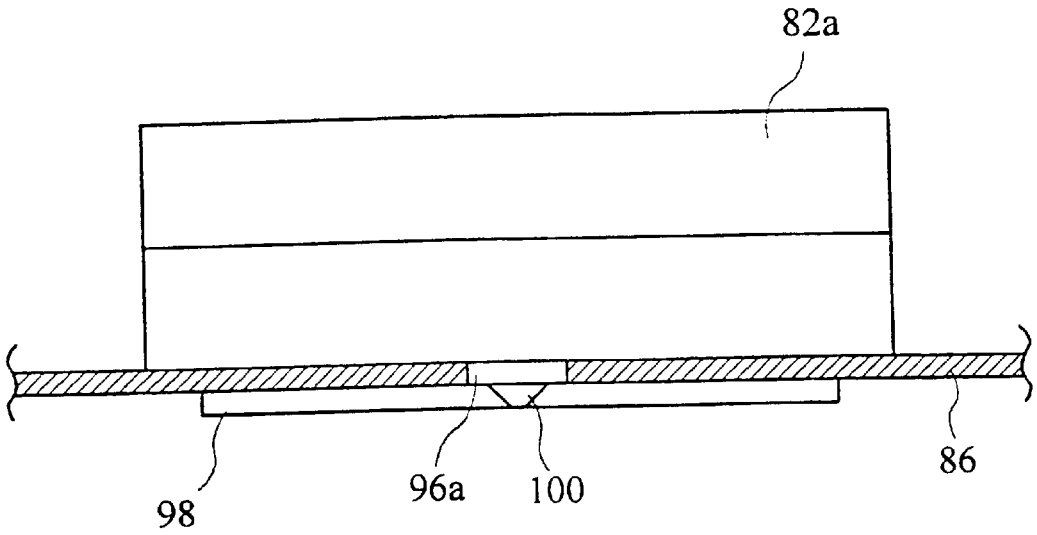
FIG. 7 shows detail of a droplet ejection opening.

FIG. 7 shows detail of a droplet ejection opening 96*a* formed in the substrate 86. Whilst the opening 96*a* itself may be formed with a taper, it is advantageous to form the tapered shape in a nozzle plate 98 mounted over the opening. Such a nozzle plate may comprise any of the readily-ablatable materials such as polyimide, polycarbonate and polyester that are conventionally used for this purpose.

Furthermore, nozzle manufacture can take place independently of the state of completeness of the rest of the printhead: the nozzle may be formed by ablation from the rear prior to assembly of the active body 82*a* onto the substrate 86 or from the front once the active body is in place. Both techniques are known in the art. The former method has the advantage that the nozzle plate can be replaced or the entire assembly rejected at an early stage in assembly, minimising the value of rejected components. The latter method facilitates the registration of the nozzles with the channels of the body when assembled on the substrate.

The construction of FIGS. 5 and 6 has two rows of nozzles formed in a single nozzle plate extending over both the openings 96*a*,96*b* in substrate 86 and extending the full length of the substrate. Following the mounting of a corresponding two rows of bodies 82*a*,82*b* and drive chips 84*a*,84*b* onto the substrate 86 and suitable testing—as described, for example, in EP-A-0 376 606—base 80 can be attached, thereby to define manifold chambers 88,90 and 92. In accordance with a further aspect of the invention, chamber 90 supplies the ends of channels formed in both bodies 82*a*,82*b* whilst chambers 88 and 92 supply the other ends of the channels in bodies 82*a*, 82*b* respectively. Conduits through which ink is supplied from the outside of the printhead to each chamber are indicated by dashed lines at 88',90' and 92'. It will be evident that this results in a particularly compact construction in which ink can be circulated from common manifold 90, through the channels in each of the bodies (for example to remove trapped dirt or air bubbles) and out through chambers 88 and 92.

Figure 8:
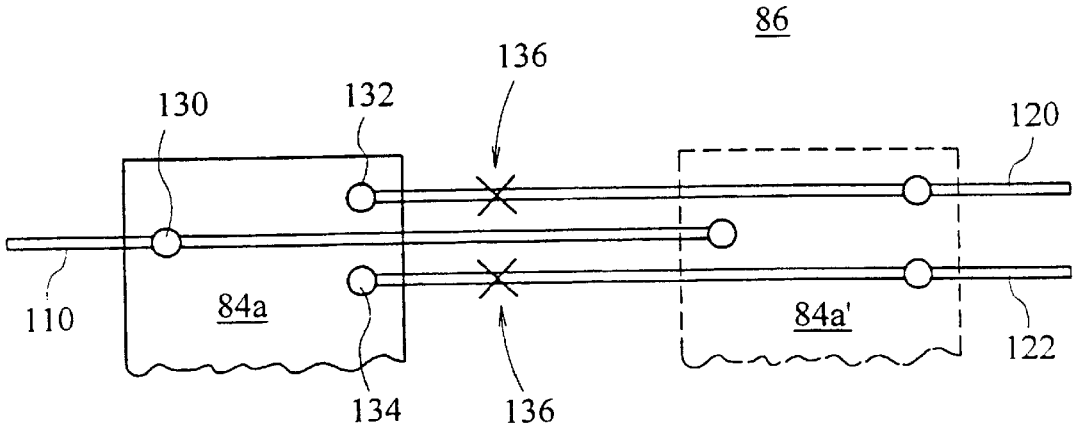
FIGS. 8 and 9 show various ways of mounting a drive chip.

FIG. 8 shows partial detail of the mounting of drive chip 84*a* on the substrate 86 having output tracks 120,122 which connect drive chip outputs 132,134 to actuating electrodes in the body and an input track 110 to drive chip input terminal 130. It will be understood that a drive chip will have many such inputs and outputs, there being generally at least twice as many outputs as inputs. 84*a* indicates the first location on the substrate 86 at which a drive chip will be placed. However, should the drive chip at this location subsequently be found to be faulty—e.g. in the course of testing as described above—a replacement chip can be mounted at location 84*a*' as indicated by dashed lines. If necessary, the connections of the faulty chip to the tracks 120 and 122 can be severed by cutting through the tracks at points 136—a laser may be particularly suitable for this purpose. The beneficial effect of this measure on manufacturing yield in a pagewide printhead—which, as shown in FIG. 5, may have several tens of driver chips—will be evident.

Figure 9:
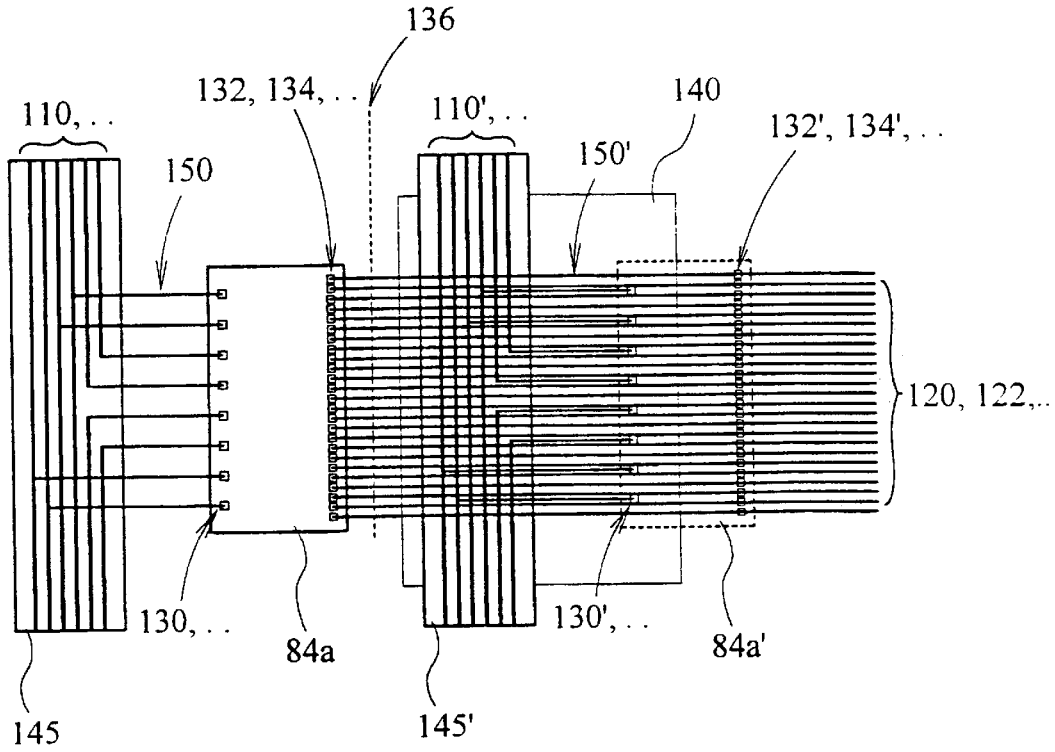

FIG. 9 shows another embodiment of this aspect of the invention in which input signals are supplied via a bus comprising tracks 110, etc. Connection between the tracks 110, etc. and chip input terminals 130 is achieved by means of further tracks 150, deposited on top of tracks 110, etc. and isolated therefrom by a passivation layer 145.

Should drive chip (integrated circuit die) 84*a* prove faulty, it is possible to connect a replacement chip or die at location 84*a*', shown dashed in FIG. 9, which is spaced from (falls outside the footprint of) the first chip 84*a*. A second bus comprising tracks 110', passivation layer 145' and further tracks 150' is used to supply input signals. A further passivation layer 140 underlies the second-bus, isolating it from output tracks 120,122, . . . which have locations for connection both to the output terminals 132,134, . . . of chip 84 and and to the output terminals 132',134' of replacement chip 84'. Excision by means of a laser along line 136 allows a faulty chip to be electrically isolated from the output tracks 120,122,. . . before a replacement chip 84' is connected.

The foregoing examples have related particularly to droplet deposition apparatus utilising piezoelectric material operated in shear mode as the actuating mechanism. Such devices are discussed, for example, in the aforementioned WO91/17051, in EP-A-0 364 136 and U.S. Pat. No. 5,227,813. The principles outlined above are equally applicable to other actuating mechanisms however, including both piezoelectric and thermal (bubble-jet), and in particular to the arrangements disclosed in co-pending UK patent application no. 9721555.2.

What is claimed is:

1. Droplet deposition apparatus comprising: a body of piezoelectric material mounted on and supported by a base, the body being formed with at least one channel open on one side, the channel communicating at each end with a supply chamber for supply of droplet fluid, the body being formed with actuator means associated with each channel for effecting ejection of droplets; a cover closing the open side of the at least one channel and having formed therein at least one opening for ejection of droplets from the channel; the base defining with the cover the supply chambers communicating with the respective ends of the at least one channel.

2. Apparatus according claim 1, wherein the base defines at least in part a further chamber, control means for supplying the electrical signals to the actuator means being located in the further chamber.

3. Apparatus according to claim 1, wherein the control means are mounted on the cover.

4. Apparatus according to claim 1, wherein the body comprises piezoelectric material.

5. Droplet deposition apparatus comprising: a body formed with at least one chamber open on one side, each chamber communicating with an opening for ejection of droplets therefrom and with a manifold for supply of droplet fluid, actuator means being associated with each chamber for effecting ejection of droplets in response to electrical signals and a cover closing the open side of the at least one chamber; the manifold being defined at least in part by a base, the base also defining at least in part a further chamber, control means for supplying the electrical signals to the actuator means being located in the further chamber.

6. Apparatus according to claim 5, wherein the actuator means are comprised in the body.

7. Apparatus according to claim 5, wherein the body and base are integral.

8. Apparatus according to claim 5, wherein the opening for ejection of droplets is formed in the cover.

9. Apparatus according to claim 5, wherein the manifold is closed by the cover.

10. Apparatus according to claim 5, wherein the further chamber is closed by the cover.

11. Apparatus according to claim 5, wherein the control means are mounted on the cover.

12. Apparatus according to claim 5, wherein the cover has at least one track thereon for conveying signals to respective actuator means.

13. Apparatus according to claim 12, wherein the cover forms a support member for the body.

14. Apparatus according to claim 5, wherein the body comprises piezoelectric material.

15. Droplet deposition apparatus comprising a body formed with at least one chamber having an open side, each chamber communicating with a supply of droplet fluid and an opening for ejection of droplets therefrom; actuator means being associated with each chamber for effecting ejection of droplets in response to electrical signals, a support member for said body, the support member closing the open side of said chamber and having at least one track thereon for conveying electrical signals to respective actuator means, and having formed therein at least one opening for ejection of droplets from respective chambers.

16. Apparatus according to claim 15, wherein a nozzle plate is attached to the opposite surface of the support member to that to which the body is attached, there being formed in the nozzle plate a nozzle communicating with the opening in the support member for ejection of droplets.

17. Apparatus according to claim 15, wherein the support member is rigid.

18. Apparatus according to claim 17, wherein the support member comprises metal and/or ceramic.

19. Apparatus according to claim 15, wherein the actuator means are comprised within the body.

20. Apparatus according to claim 15, wherein the body comprises piezoelectric material.

21. Apparatus for printing on a substrate according to claim 15, comprising a plurality of openings for ejection of droplets from a respective plurality of chambers, the plurality of openings being arranged in at least one linear array extending in the widthwise direction of the substrate and transversely to the direction of motion of the substrate relative to the apparatus, the support member extending over the entire width of the substrate.

22. Apparatus according to claim 15, comprising a plurality of openings for ejection of droplets from a respective plurality of chambers, the plurality of openings being arranged in at least one linear array extending in an array direction, wherein each chamber is formed as a channel having a longitudinal channel axis, the channel axis extending transversely to the array direction.

23. Apparatus according to claim 20, wherein an array of channels is formed in said body, successive channels in the array defining sidewalls therebetween, said sidewalls comprising piezoelectric material.

* * * * *